US007611132B2

(12) United States Patent
Ben-Gigi

(10) Patent No.: US 7,611,132 B2
(45) Date of Patent: Nov. 3, 2009

(54) CLAMP ACCESSORY

(75) Inventor: Zion Ben-Gigi, Kfar Veradim (IL)

(73) Assignee: Tefentools Ltd., Tefen (IL)

( * ) Notice: Subject to any disclaimer, the term of this patent is extended or adjusted under 35 U.S.C. 154(b) by 0 days.

(21) Appl. No.: 11/779,305

(22) Filed: Jul. 18, 2007

(65) Prior Publication Data

US 2008/0012192 A1 Jan. 17, 2008

Related U.S. Application Data

(63) Continuation of application No. 10/513,033, filed on Nov. 1, 2004, now abandoned.

(30) Foreign Application Priority Data

Feb. 27, 2002 (IL) ..... 148434
Feb. 27, 2003 (WO) ..... PCT/IL03/00151

(51) Int. Cl.
*B25B 11/00* (2006.01)

(52) U.S. Cl. ..... 269/6; 269/3

(58) Field of Classification Search ..... 269/6, 269/329, 296, 37, 152, 95–99, 3; 446/127, 446/106, 125

See application file for complete search history.

(56) References Cited

U.S. PATENT DOCUMENTS

| | | | | |
|---|---|---|---|---|
| 1,375,686 | A | 4/1921 | Felton | |
| 2,452,089 | A | 10/1948 | Wiken et al | |
| 3,305,100 | A * | 2/1967 | Barbee | 211/120 |
| 4,770,400 | A * | 9/1988 | Questel | 269/104 |
| 6,305,679 | B1 * | 10/2001 | Brill | 269/133 |
| 6,508,518 | B1 | 1/2003 | Owen et al. | |

FOREIGN PATENT DOCUMENTS

| | | |
|---|---|---|
| DE | 655665 | 1/1938 |
| DE | 917093 | 8/1954 |
| DE | 2931517 | 2/1981 |
| FR | 2652026 | 3/1991 |

* cited by examiner

*Primary Examiner*—Lee D Wilson
(74) *Attorney, Agent, or Firm*—Dekel Patent Ltd.; David Klein

(57) ABSTRACT

A clamp accessory including a support element comprising a mounting surface adapted to rest on a work surface, the support element formed with at least one notch adapted to receive therein a bar of a bar clamp and support the bar at a distance spaced from the work surface.

4 Claims, 2 Drawing Sheets

CLAMP ACCESSORY

CROSS-REFERENCE TO RELATED APPLICATIONS

This application is a continuation of U.S. patent application Ser. No. 10/513,033, filed Nov. 1, 2004, now abandoned, and claims priority therefrom.

FIELD OF THE INVENTION

The present invention relates generally to accessories for clamps, and particularly to an accessory for a bar clamp.

BACKGROUND OF THE INVENTION

Bar clamps are well known tools used in many carpentry and handicraft applications. Bar clamps generally comprise a pair of clamping jaws that slide along a bar. A workpiece may be clamped between the jaws by abutting the jaws against opposite sides of the workpiece, and then tightening the jaws against the workpiece, such as by repetitive squeezing of a hand-held trigger mechanism.

The bar clamp may also be used to spread objects apart. This may be accomplished by turning around the clamping jaws 180°, which reverses the advancing movement of the jaws along the bar towards each other into a retreating movement away from each other. The objects may be spread apart by abutting the jaws against the appropriate surfaces of the objects, and then moving the jaws in the spreading direction, such as by repetitive squeezing of the hand-held trigger mechanism.

Bar clamps may be manufactured and sold in different sizes to match the needs of carpenters and tradesmen. However, bar clamps are not readily available for clamping long-dimensioned objects, such as for gluing strips to edges of tabletops.

SUMMARY OF THE INVENTION

The present invention seeks to provide an accessory for clamps, particularly bar clamps, that may increase the effective clamping length of the clamp.

There is thus provided in accordance with a preferred embodiment of the present invention a clamp accessory including a support element comprising a mounting surface adapted to rest on a work surface, the support element formed with at least one notch adapted to receive therein a bar of a bar clamp and support the bar at a distance spaced from the work surface.

In accordance with a preferred embodiment of the present invention the support element includes a hub including a base and a rim extending at least partially around a perimeter of the base, the rim having at least one pair of notches formed thereon, the notches being adapted to fixedly receive therein a bar of a bar clamp.

The notches may be formed on opposite sides of a center of the base. The notches may be formed symmetrically about the center of the base.

Further in accordance with a preferred embodiment of the present invention pairs of the notches are spaced generally equidistantly from each other.

Still further in accordance with a preferred embodiment of the present invention the pairs of notches are spaced at preset angles from each other.

Alternatively, at least two of the pairs of notches are not spaced equidistantly from one another.

In accordance with a preferred embodiment of the present invention the support element includes an anti-slip mounting surface and/or an anti-marring mounting surface.

In accordance with a preferred embodiment of the present invention the at least one notch includes a snap fastener adapted to snappingly receive a bar of a bar clamp, and permit sliding the support element along the bar.

Further in accordance with a preferred embodiment of the present invention the clamp accessories are connectable to one another.

There is also provided in accordance with a preferred embodiment of the present invention a clamp assembly including a support element including a mounting surface adapted to rest on a work surface, the support element formed with at least one notch, and at least one bar clamp including a bar receivable in the at least one notch, a clamping jaw movable along the bar, and a tightening mechanism for tightening the clamping jaw against a surface, the support element being adapted to support the bar at a distance spaced from the work surface.

BRIEF DESCRIPTION OF THE DRAWINGS

The present invention will be understood and appreciated more fully from the following detailed description taken in conjunction with the drawings in which.

DETAILED DESCRIPTION OF THE PREFERRED EMBODIMENT

Figure 1:
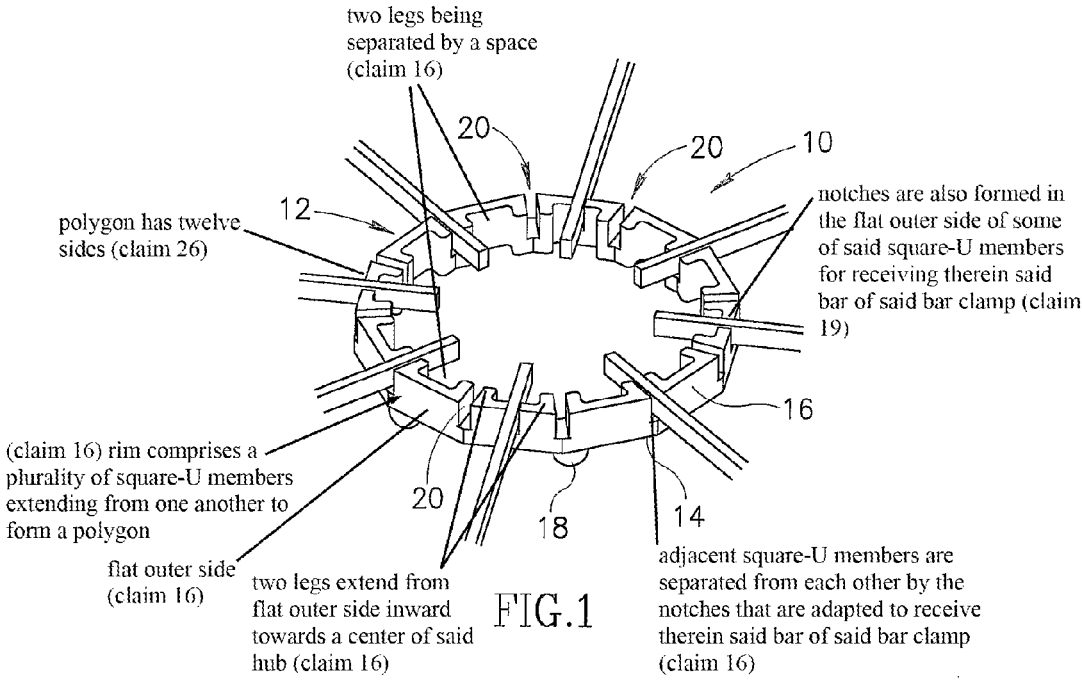
FIG. 1 is a simplified pictorial illustration of a clamp accessory, constructed and operative in accordance with a preferred embodiment of the present invention.

Reference is now made to FIG. 1, which illustrates a clamp accessory 10, constructed and operative in accordance with a preferred embodiment of the present invention.

Clamp accessory 10 preferably comprises a support element 11 that includes a hub 12 comprising a base 14 and a rim 16 extending at least partially around a perimeter of base 14. Hub 12 may be of any shape, such as but not limited to, circular, elliptical, rectangular, square, polygonal or any other arbitrary shape. Clamp accessory 10 may be constructed of any sturdy material, such as but not limited to, metal, plastic or wood. A mounting surface 18 of hub 12 is preferably anti-slip and/or anti-marring for resting on a work surface 19. The mounting surface 18 may be flush with the bottom of hub 12 or may comprise mounting legs with felt pads, for example.

One or more pairs of notches 20 are preferably formed in rim 16, e.g., about a center of base 14. In one embodiment of the invention, notches 20 are formed on opposite sides of the center of base 14, and may be symmetrical about the center of base 14. Pairs of opposing notches 20 may be spaced generally equidistantly from each other about rim 16. The notches 20 may be spaced at preset angles so as to help clamp workpieces at desired angles. Alternatively, the notches 20 may be spaced apart not equidistantly, but rather at different intervals.

Figure 2:
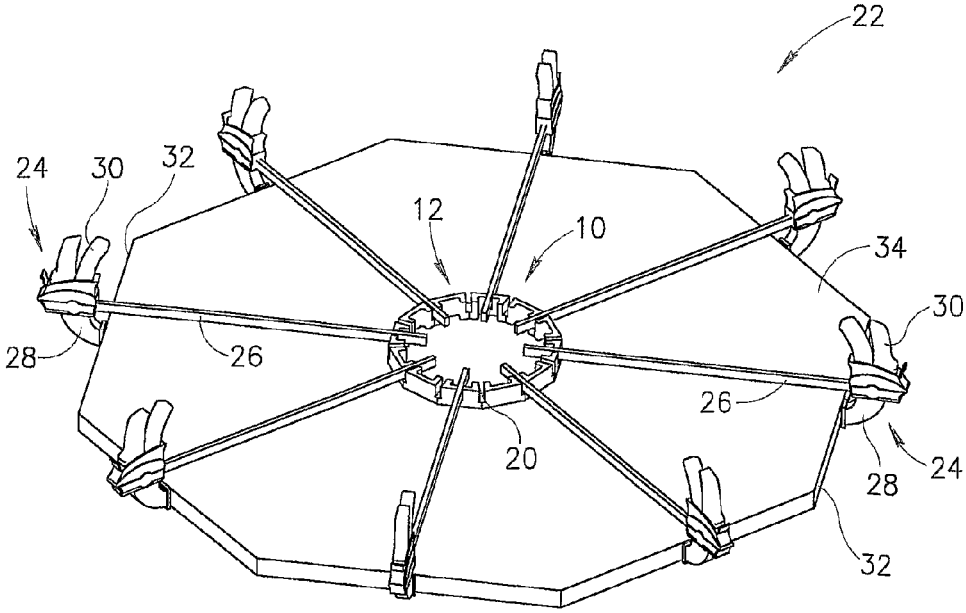
FIG. 2 is a simplified pictorial illustration of a clamp assembly using the clamp accessory of FIG. 1, in accordance with a preferred embodiment of the present invention.

Reference is now made additionally to FIG. 2, which illustrates a clamp assembly 22 using the clamp accessory 10, in accordance with a preferred embodiment of the present invention. Clamp assembly 22 preferably includes one or more pairs of bar clamps 24. Each bar clamp 24 preferably includes an elongate bar 26, one or more clamping jaws 28 movable along bar 26, and a tightening mechanism 30, such as a hand-held trigger mechanism, for tightening clamping jaw 28 against a surface 32 of a workpiece 34. Bar clamps 24 normally are provided with a pair of clamping jaws 28, however, for use with the clamp accessory 10, one of the clamping jaws 28 is preferably removed. One of the pair of bar clamps 24 may be arranged such that one end of the bar 26 is fixedly received in one of the notches 20 and the remaining clamping jaw 28 is abutted against surface 32. Each elongate bar 26 may be provided with a pin or other protuberance 36 that abuts against an inner surface of rim 16 to hold bar 26 in place in notch 20 when tightening the bar clamp 24. The other of the pair of bar clamps 24 may continue along the same axis, that is, 180° from the first bar clamp to clamp or spread opposing surfaces of the workpiece 34. Alternatively or additionally, the other of the pair of bar clamps 24 may be placed at other positions about the hub 12. The clamp assembly 22 thus permits extending the reach of the bar clamps for clamping or spreading a wide variety of objects.

Figure 3:
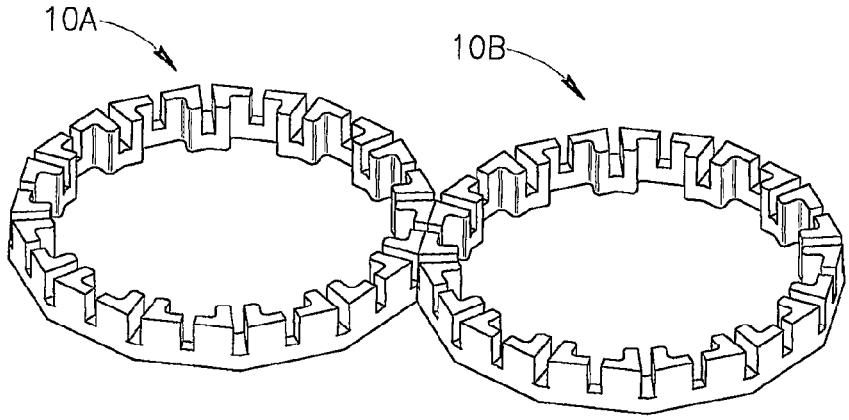
FIG. 3 is a simplified pictorial illustration of a modular construction of the clamp accessories of FIG. 1, in accordance with a preferred embodiment of the present invention.

Reference is now made to FIG. 3, which illustrates that the clamp accessories may be made of a modular construction, wherein one clamp accessory 10A may be connectable or otherwise joinable to another clamp accessory 10B, thereby further extending the effective clamping length of the bar clamps.

Figure 4:
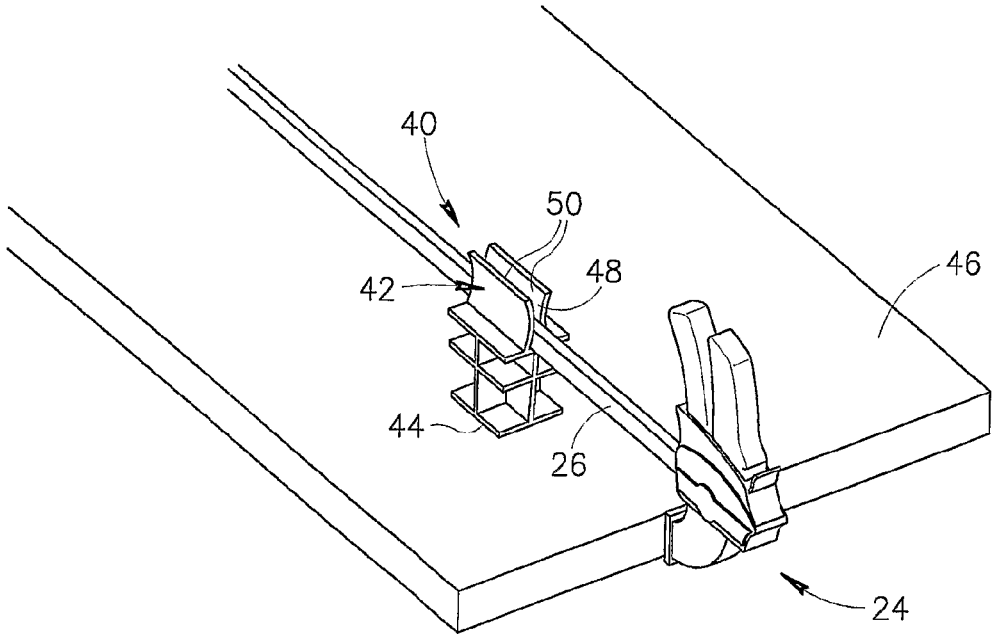
FIG. 4 is a simplified pictorial illustration of a clamp accessory, constructed and operative in accordance with another preferred embodiment of the present invention.

Reference is now made to FIG. 4, which illustrates another clamp accessory 40, constructed and operative in accordance with another embodiment of the present invention. Clamp accessory 40 preferably comprises a support element 42 that includes a mounting surface 44 adapted to rest on a work surface 46. Support element 42 may be formed with one or more notches 48 adapted to receive therein bar 26 of bar clamp 24. Support element 42 preferably supports the bar 26 at a distance spaced from the work surface 46. The mounting surface 44 may be anti-slip and/or anti-marring.

Notch 48 may comprise a snap fastener 50. Bar 26 of bar clamp 24 may be snapped into snap fastener 50, and support element 42 may slide along bar 26 to any desired position therealong. Clamp accessory 40 may thus conveniently support bar 26 at any position and prevent bar 26 from sagging or falling.

It will be appreciated by person skilled in the art that the present invention is not limited by what has been particularly shown and described herein above. Rather the scope of the present invention is defined only by the claims that follow:

What is claimed is:

1. A combination of clamp accessories with a bar clamp comprising:

a bar clamp comprising a bar; and a first support element comprising a mounting surface adapted to rest on a work surface, said first support element comprising a hub comprising a base and a rim extending at least partially around a perimeter of said base, said rim having at least one pair of notches formed thereon, said notches being adapted to receive therein said bar of said bar clamp and support the bar at a distance spaced from the work surface;

wherein said rim comprises a plurality of square-U members extending from one another to form a polygon, each square-U member comprising a flat outer side from which two legs extend inward towards a center of said hub, the two legs being separated by a space, and wherein adjacent square-U members are separated from each other by the notches that are adapted to receive therein said bar of said bar clamp.

2. The combination according to claim 1, wherein notches are also formed in the flat outer side of some of said square-U members for receiving therein said bar of said bar clamp.

3. The combination according to claim 2, wherein said pairs of notches are spaced at preset angles from each other.

4. The combination according to claim 1, wherein said polygon has twelve sides.

* * * * *